US006659844B2

(12) United States Patent
Shaw

(10) Patent No.: US 6,659,844 B2
(45) Date of Patent: Dec. 9, 2003

(54) PLIANT COATING STRIPPING

(75) Inventor: James Stephen Shaw, Hampton Falls, NH (US)

(73) Assignee: General Electric Company, Schenectady, NY (US)

( * ) Notice: Subject to any disclaimer, the term of this patent is extended or adjusted under 35 U.S.C. 154(b) by 122 days.

(21) Appl. No.: 09/867,229

(22) Filed: May 29, 2001

(65) Prior Publication Data

US 2002/0182987 A1 Dec. 5, 2002

(51) Int. Cl.[7] ..... B24C 3/00
(52) U.S. Cl. ..... 451/38; 451/75; 451/37
(58) Field of Search ..... 451/38, 40, 53, 451/60, 90, 102, 75; 239/15, 37, 134, 141

(56) References Cited

U.S. PATENT DOCUMENTS

| | | | | | |
|---|---|---|---|---|---|
| 4,548,617 | A | * | 10/1985 | Miyatani et al. | 51/293 |
| 5,177,911 | A | * | 1/1993 | Ruemelin et al. | 451/89 |
| 5,234,470 | A | * | 8/1993 | Lynn et al. | 51/293 |
| 5,239,788 | A | * | 8/1993 | Woodson | 451/39 |
| 5,283,985 | A | * | 2/1994 | Browning | 451/38 |
| 5,344,472 | A | * | 9/1994 | Lynn et al. | 51/293 |
| 5,390,450 | A | * | 2/1995 | Goenka | 451/102 |
| 5,445,553 | A | * | 8/1995 | Cryer et al. | 451/39 |
| 5,525,093 | A | * | 6/1996 | Palmer, Jr. | 451/40 |
| 5,529,589 | A | * | 6/1996 | Lynn et al. | 51/293 |
| 5,718,581 | A | * | 2/1998 | Fernwood et al. | 433/88 |
| 5,971,837 | A | * | 10/1999 | McDavid | 451/89 |
| 6,012,968 | A | | 1/2000 | Lofaro | |
| 6,036,584 | A | * | 3/2000 | Swinkels et al. | 451/102 |
| 6,126,513 | A | * | 10/2000 | Oshio et al. | 451/28 |
| 6,183,347 | B1 | * | 2/2001 | Shaw | 451/36 |
| 6,273,788 | B1 | * | 8/2001 | Shaw | 451/38 |
| 6,347,976 | B1 | * | 2/2002 | Lawton et al. | 451/38 |
| 6,368,195 | B1 | * | 4/2002 | Oshio et al. | 451/38 |
| 6,402,068 | B1 | * | 6/2002 | Handleman | 241/39 |
| 6,402,593 | B1 | * | 6/2002 | Shaw | 451/36 |
| 6,464,570 | B1 | * | 10/2002 | Shaw et al. | 451/102 |

FOREIGN PATENT DOCUMENTS

| | | |
|---|---|---|
| EP | 0178164 | 4/1986 |
| EP | 0430856 | 6/1991 |

* cited by examiner

*Primary Examiner*—Lee D. Wilson
(74) *Attorney, Agent, or Firm*—V. G. Ramaswamy; Francis L. Conte

(57) ABSTRACT

Abrasive shot is injected into a carrier stream of compressed gas. The shot and gas stream are directed against a pliant coating. The compressed gas expands at the coating for cooling thereof which decreases coating resiliency for enhancing stripping thereof by the impinging abrasive shot.

20 Claims, 2 Drawing Sheets

PLIANT COATING STRIPPING

BACKGROUND OF THE INVENTION

The present invention relates generally to repair processes, and, more specifically, to surface stripping.

The manufacture of typical products occurs in various steps from raw material to finished article. Various coatings may be applied to the external surface of the finished product for various reasons. For example, the product may be coated with paint for durability and aesthetic reasons. Or, such coatings may be pliant in the form of various synthetic rubber.

Such coatings may be found in consumer and industrial products, manufacturing equipment or machinery, and commercial or military aircraft and aircraft engines for various purposes. In many of these typical applications, it is desirable to remove the original coating after extended time and service and reapply a new coating for further extending service.

Pliant coatings are particularly difficult to remove in view of the flexibility and resilience thereof. Abrasive grit blasting is inefficient since the small particles of airborne girt dissipate their kinetic energy as the pliant coating resiliently deforms under impact. And, hot knife removal of the pliant coating is labor intensive.

Accordingly, it is desired to provide a new method of stripping pliant coatings with increased efficacy.

BRIEF SUMMARY OF THE INVENTION

Abrasive shot is injected into a carrier stream of compressed gas. The shot and gas stream are directed against a pliant coating. The compressed gas expands at the coating for cooling thereof which decreases coating resiliency for enhancing stripping thereof by the impinging abrasive shot.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
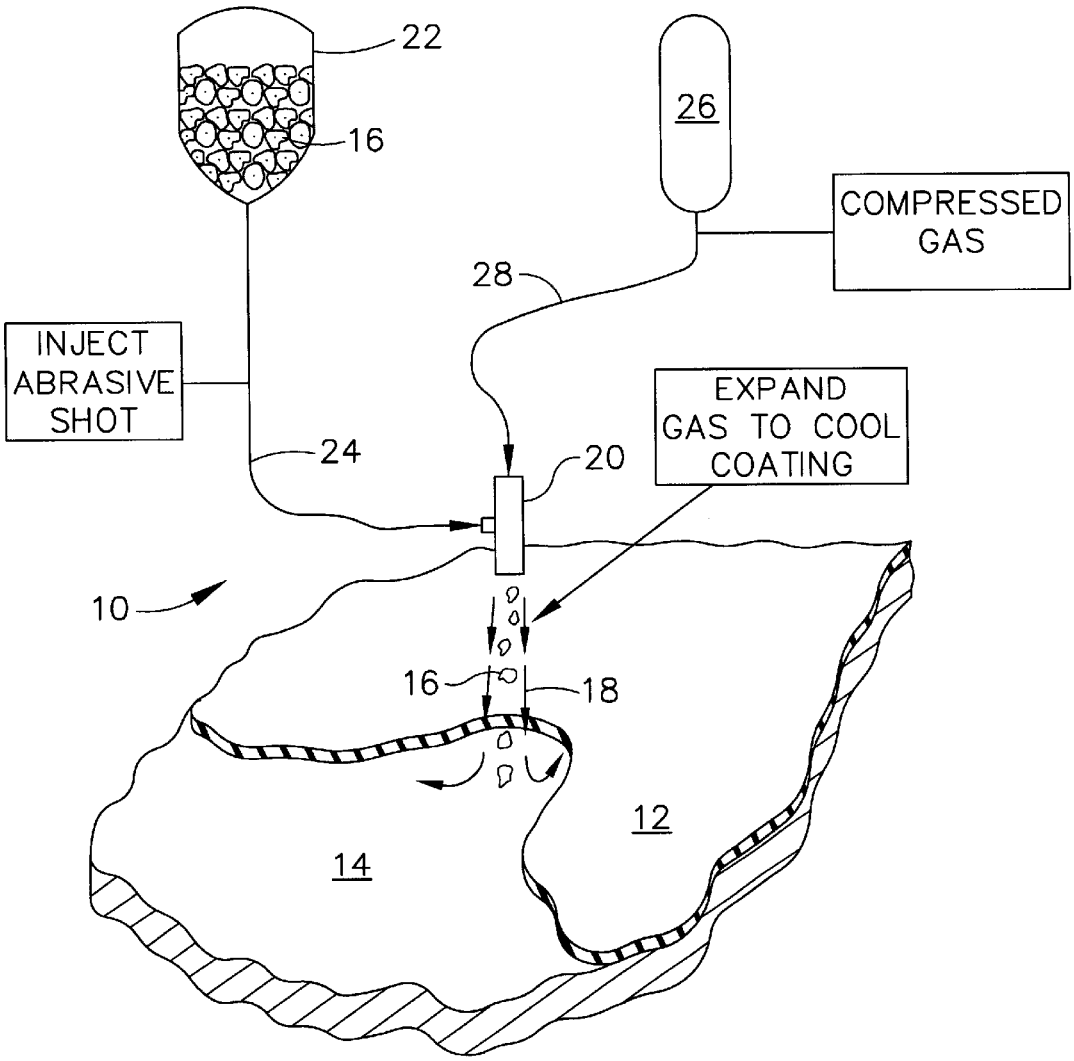
FIG. 1 is a schematic representation of an apparatus and associated method for stripping a pliant coating from a workpiece in accordance with an exemplary embodiment of the present invention.

Illustrated in FIG. 1 is an apparatus 10 for stripping a pliant coating 12 from the external surface of a workpiece 14 in accordance with an exemplary embodiment of the present invention. The workpiece may have any suitable form such as a part in commercial or industrial products, manufacturing equipment and machinery, or in military or commercial aircraft or gas turbine engines thereof.

The pliant coating 12 may have any suitable form as desired for these products, and is typically in the form of a thin coating which is flexible and pliable for various aesthetic or functional reasons.

For example, the pliant coating may be a synthetic rubber, like silicone, having a smooth and continuous outer surface when applied. And the coating is resilient under contact and readily returns to its original shape. However, after extended use in service, the pliant coating may degrade due to wear or other reasons, and the removal and replacement by a new coating is desired.

Accordingly, the apparatus 10 illustrated in FIG. 1 is specifically configured for efficiently stripping the pliant coating 12 from the workpiece notwithstanding the inherent flexibility of the coating being removed. Means are provided for supplying abrasive shot 16 in a compressed gas 18 through a common discharge nozzle 20 tar blasting against the pliant coating 12 for stripping or removal thereof from the underlying workpiece 14.

The shot is initially stored in a suitable hopper 22 having a discharge conduit or hose 24 joined to the nozzle 20. A suitable gas supply 26, such as a bottle or canister of compressed gas, is joined by another conduit or hose 28 to the common nozzle 20.

The shot may be gravity or force fed through the supply hose 24 to the nozzle, with the compressed gas 18 being suitably regulated in flowrate to the nozzle. In this way, a stream of the abrasive shot may be injected into a carrier stream of the compressed gas inside the nozzle 20 for discharge therefrom against the pliant coating.

The nozzle 20 may then be manually or automatically carried in a translating carriage over the workpiece for directing or impinging the shot and gas stream against the coating. The initially compressed gas being discharged from the nozzle expands to ambient pressure at the surface of the coating for significantly cooling that coating to decrease its resilience and permit enhanced stripping thereof by the abrasive shot carried in the gas stream.

Figure 2:
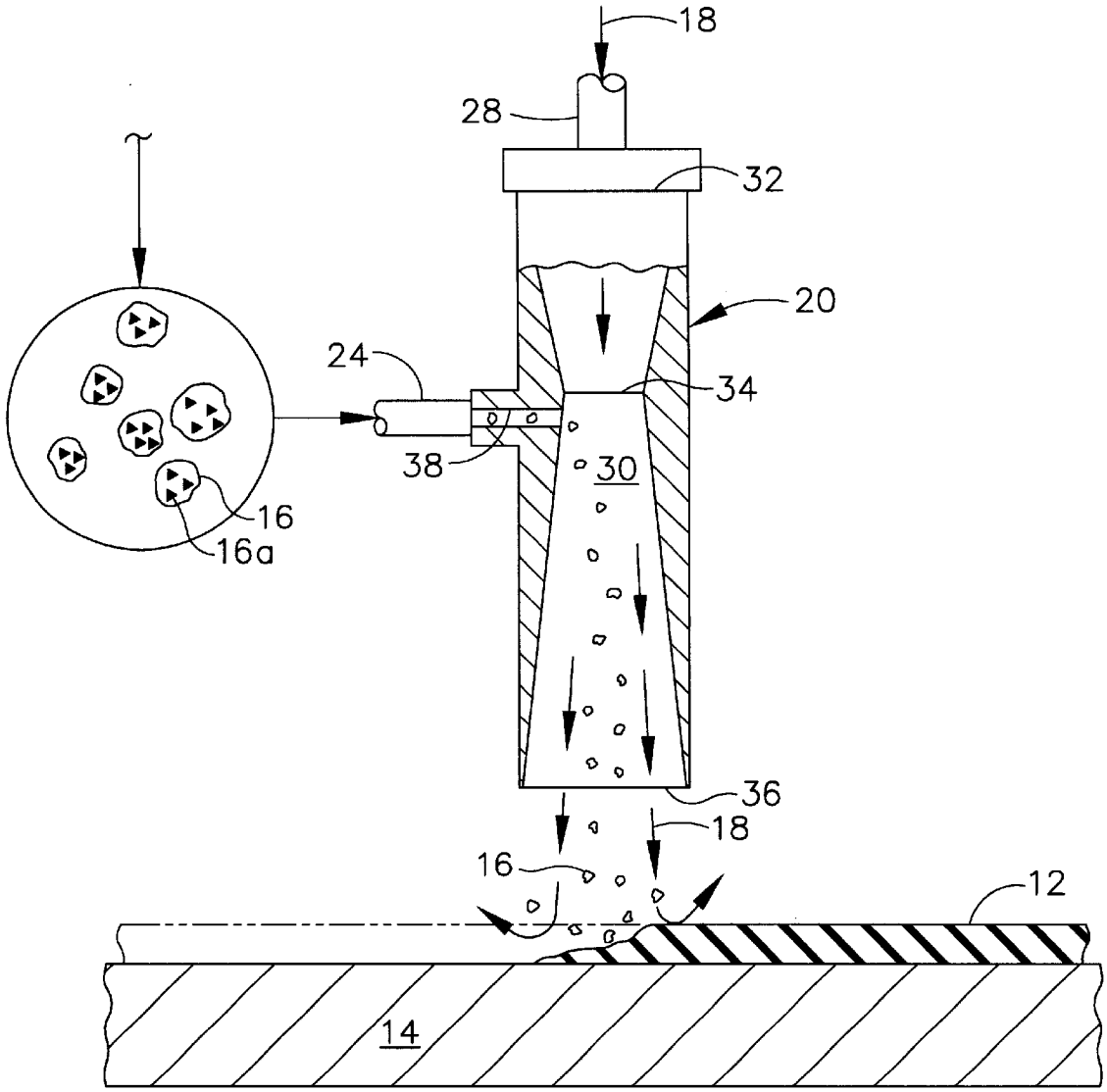
FIG. 2 is a partly sectional elevational view of the nozzle illustrated in FIG. 1 for discharging abrasive shot in a compressed gas against the pliant coating for stripping thereof in an exemplary embodiment.

FIG. 2 illustrates in more particularity the nozzle 20 suitably positioned over the workpiece, with the abrasive shot 16 being shown magnified in part for clarity of presentation. The shot preferably comprises a multitude of individual pellets each having a plurality of abrasive particles 16*a* imbedded therein. The shot pellets are preferably dense plastic of any suitable composition, with the abrasive particles having any suitable material composition, such as various minerals, which are imbedded in the pellets for exposure around the surrounding surface thereof.

The carrier gas 18 has two fundamental purposes for carrying the abrasive shot 16 in impingement against the pliant coating while simultaneously cooling the pliant coating as the gas expands during impingement thereof. Expansion of compressed gas removes heat from the pliant coating and reduces its temperature significantly for correspondingly reducing the resilience and flexibility thereof. In this way, as the abrasive shot impinges the cooled coating, the coating is less susceptible to elastic deformation and the kinetic energy of the shot is more effective for abrading and stripping the stiffened or hardened coating from the workpiece surface.

The carrier gas introduces kinetic energy into the abrasive shot as it is accelerated through the nozzle to a high velocity for impinging the coating. Kinetic energy of the abrasive particles is substantially increased by the larger plastic pellets in which they are imbedded. Since the coating is cooled by the expanding gas its flexibility is substantially reduced, and the stream of relatively large pellets carrying particles of abrasive have enhanced kinetic energy for abrading and stripping the pliant coating. This combination of features is referred to as Kinetic Energy Enhancement for Pliant Coating Stripping (KEEPCS).

In the preferred embodiment, the compressed gas 18 is carbon dioxide for its substantial cooling ability under expansion to ambient pressure, and since it is relatively inexpensive. Other suitable gases, such as compressed nitrogen, could also be used for their ability to effectively cool the pliant coating. However, compressed nitrogen is more expensive to use than compressed carbon dioxide.

In the preferred method, the compressed gas expands as it impinges against the pliant coating 12 to substantially harden that coating by cooling thereof for stripping the coating from the workpiece surface by the impinging abrasive shot carried by the gas. Although air may be compressed and used as the carrier gas, compressed air has little efficacy in reducing the temperature of the pliant coating for decreasing its resiliency.

Accordingly, compressed air is not preferred in practicing the stripping process, with carbon dioxide being preferred instead for its substantial cooling capability upon expansion from its initial storage pressure. And, suitable canisters of compressed carbon dioxide are commercially available and are readily joined to the nozzle in a simple configuration for use in stripping the pliant coating.

As shown in FIG. 2 the nozzle 20 is located sufficiently close to the surface of the workpiece so that the abrasive shot and gas stream discharged therefrom can impinge obliquely against the coating for stripping thereof. Substantially normal or perpendicular impingement of the abrasive shot maximizes the transfer of kinetic energy from the shot into the temporarily hardened pliant coating for abrasion and stripping thereof from the underlying workpiece surface. However, the nozzle may be inclined at acute angles of incidence where desired for also stripping the pliant coating with less efficacy.

In the preferred embodiment illustrated in FIG. 2, the compressed gas 18 is discharged through an eductor nozzle in which the abrasive shot 16 may be entrained by vacuum formed in the nozzle. The eductor nozzle 20 is a tubular member having a center venturi 30 therein which converges in flow area from a circular gas inlet 32 at the proximal end of the nozzle to a throat 34 of minimum flow area in the middle region of the nozzle and diverges in flow area to a circular outlet 36 at the opposite, distal end of the nozzle.

A side inlet 38 is joined to the shot hose 24 for receiving the stream of abrasive shot. The shot inlet 38 is preferably located downstream of the throat 34 in the diverging portion of the venturi so that as the compressed gas is channeled through the nozzle and expands through the venturi, vacuum is created at the shot inlet 38 for entraining the abrasive shot therein.

In this way, the abrasive shot is drawn into the nozzle by the compressed carrier gas being discharged therethrough, with the shot and gas stream then being directed in impingement against the pliant coating 12 which is cooled by the expanding gas and abraded by the impinging abrasive shot carried therein.

The pliant coating 12 may vary in thickness from relatively thin to relatively thick, yet is readily stripped by the abrasive action of the high kinetic energy plastic pellets having the abrasive particles carried therein. As the pliant coating is cooled and abrasively stripped from the workpiece surface, the nozzle may be moved laterally across the workpiece for correspondingly stripping the coating from the entire intended region thereof.

Stripping of the pliant coating may therefore be effected with a substantial increase in efficiency over hot knife removal of the coating. And, the cooling capability of the compressed carbon dioxide carrier gas in conjunction with the plastic carrier pellets and abrasive imbedded therein substantially increases the kinetic energy of the abrasive particles and efficacy thereof in stripping the coating as compared with conventional abrasive grit blasting in which small particles of abrasive are carried in a stream of air.

The plastic pellets may be varied in size as desired for carrying a suitable number of abrasive particles in each pellet to increase the collective kinetic energy thereof. And, the self-cooling capability of the compressed carrier gas simultaneously pretreats the pliant coating for reducing its resilience and correspondingly increasing the abrasion thereof by the abrasive pellets. This self-cooling, multi-particle shot blasting process may be used to remove pliant coatings in various parts and products where economically feasible.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claim in which I claim:

1. A method of stripping comprising:

providing a workpiece having a pliant coating thereon;

injecting abrasive shot into a carrier stream of compressed gas;

directing said shot and gas stream against said coating; and expanding said compressed gas in said stream at said coating for cooling said coating to decrease resilience thereof for stripping by said shot.

2. A method according to claim 1 wherein said shot comprises a multitude of pellets each having abrasive particles imbedded therein.

3. A method according to claim 2 further comprising impinging said shot and gas stream obliquely against said coating for stripping thereof.

4. A method according to claim 3 further comprising discharging said compressed gas through an eductor nozzle and entraining said shot by vacuum therein.

5. A method according to claim 4 further comprising impinging said expanding gas against said pliant coating to harden said coating by cooling for stripping thereof by said impinging shot.

6. A method according to claim 4 wherein said compressed gas comprises carbon dioxide.

7. A method according to claim 6 wherein said pellets comprise plastic, with said abrasive particles being exposed at the surface thereof.

8. A method according to claim 1 wherein said coating is flexible, pliable, and resilient, and said compressed gas is effective for decreasing resilience of said coating to enhance stripping of said coating by said shot.

9. A method according to claim 1 wherein said expanding gas is effective for hardening said coating for enhanced abrading thereof by said shot.

10. A method according to claim 1 wherein said compressed gas is not air.

11. A method of stripping comprising:

providing a workpiece having a pliant coating thereon;

injecting into a carrier stream of compressed carbon dioxide gas abrasive shot including a multitude of pellets having abrasive particles imbedded therein;

directing said shot and gas stream against said coating; and expanding said compressed gas in said stream at said coating for cooling said coating to decrease resilience thereof for stripping by said shot.

12. A method according to claim 11, wherein said pellets comprise plastic, with said abrasive particles being exposed at the surface thereof.

13. A method according to claim 12 further comprising discharging said compressed gas through an eductor nozzle and entraining said shot by vacuum therein.

14. An apparatus for stripping a pliant coating from a workpiece comprising:

a hopper containing abrasive shot;

a canister containing compressed gas, said gas having a different material composition than said shot;

a nozzle having a shot inlet and a gas inlet, and a common outlet;

means for supplying abrasive shot from said hopper to said nozzle shot inlet;

means for supplying compressed gas from said canister to said nozzle gas inlet for discharge with said abrasive shot as a stream from said common nozzle outlet; and said compressed gas being effective for expanding upon discharge from said nozzle for cooling said coating to decrease resilience thereof for stripping by said shot.

15. An apparatus according to claim 14 wherein said shot comprises a multitude of pellets each having abrasive particles imbedded therein.

16. An apparatus according to claim 15 wherein said nozzle comprises an eductor having a venturi therein, with said gas inlet and outlet being disposed at opposite ends of said venturi and said shot inlet being disposed therebetween for entraining said shot by vacuum generated therein.

17. An apparatus according to claim 16 wherein said compressed gas comprises carbon dioxide.

18. An apparatus according to claim 1 wherein said pellets comprise plastic, with said abrasive particles being exposed at the surface thereof.

19. A method according to claim 14 wherein said expanding gas is effective for hardening said coating for enhanced abrading thereof by said shot.

20. A method according to claim 14 wherein said canister contains a compressed gas excluding air.

* * * * *

UNITED STATES PATENT AND TRADEMARK OFFICE

CERTIFICATE OF CORRECTION

PATENT NO. : 6,659,844 B2
DATED : December 9, 2003
INVENTOR(S) : James Stephen Shaw It is certified that error appears in the above-identified patent and that said Letters Patent is hereby corrected as shown below:

Column 6,
Line 15, delete "1" and substitute therefor -- 17 --;
Lines 18 and 21, delete "A method" and substitute therefor -- An apparatus --.

Signed and Sealed this

Twenty-third Day of March, 2004

JON W. DUDAS
*Acting Director of the United States Patent and Trademark Office*